US010811761B2

(12) United States Patent
Yang et al.

(10) Patent No.: US 10,811,761 B2
(45) Date of Patent: Oct. 20, 2020

(54) INFORMATION CARRIER AND TAG ANTENNA STRUCTURE THEREOF

(71) Applicant: AUDEN TECHNO CORP., Taoyuan (TW)

(72) Inventors: Chang-Fa Yang, Taipei (TW); An-Yao Hsiao, Taoyuan (TW); Chen-Pang Chao, Taoyuan (TW); Cheng-Han Tsai, New Taipei (TW)

(73) Assignee: AUDEN TECHNO CORP., Taoyuan (TW)

( * ) Notice: Subject to any disclaimer, the term of this patent is extended or adjusted under 35 U.S.C. 154(b) by 81 days.

(21) Appl. No.: 16/148,709

(22) Filed: Oct. 1, 2018

(65) Prior Publication Data

US 2020/0106154 A1 Apr. 2, 2020

(51) Int. Cl.

| | |
|---|---|
| ***H01Q 7/00*** | (2006.01) |
| ***H01Q 1/22*** | (2006.01) |
| ***H01Q 1/38*** | (2006.01) |

(52) U.S. Cl.

CPC ..... *H01Q 1/2208* (2013.01); *H01Q 1/38* (2013.01); *H01Q 7/00* (2013.01)

(58) Field of Classification Search

CPC ..... H01Q 1/38; H01Q 1/2208; H01Q 21/061; H01Q 1/40; H01Q 1/2225; H01Q 9/265

See application file for complete search history.

(56) References Cited

U.S. PATENT DOCUMENTS

| | | | | |
|---|---|---|---|---|
| 6,285,342 | B1 * | 9/2001 | Brady | G06K 19/07749 343/895 |
| 2006/0044769 | A1 * | 3/2006 | Forster | G06K 19/07749 361/760 |
| 2009/0289852 | A1 * | 11/2009 | Li | H01Q 1/3291 343/700 MS |
| 2010/0136912 | A1 * | 6/2010 | Mohammadian | H01Q 1/243 455/41.3 |
| 2012/0056790 | A1 * | 3/2012 | Lee | H01Q 7/00 343/702 |
| 2012/0249396 | A1 * | 10/2012 | Parsche | H01Q 1/243 343/866 |
| 2014/0132465 | A1 * | 5/2014 | Sanchez | H01Q 1/243 343/748 |
| 2015/0048991 | A1 * | 2/2015 | Pajona | H01Q 7/00 343/852 |
| 2017/0352960 | A1 * | 12/2017 | Zhang | H01Q 9/0464 |
| 2019/0260118 | A1 * | 8/2019 | Moon | H01Q 1/273 |

* cited by examiner

*Primary Examiner* — Awat M Salih
(74) *Attorney, Agent, or Firm* — Li & Cai Intellectual Property (USA) Office

(57) ABSTRACT

A tag antenna structure of an information carrier includes a carrying sheet and a tag antenna disposed on the carrying sheet. An outer lateral edge of the carrying sheet is symmetrical to a first central axis, and a distance between the outer lateral edge of the carrying sheet and the first central axis is defined as a first outer radius. The tag antenna includes an annular segment and two extending segments respectively extending from two end portions of the annular segment. An outer lateral edge of the annular segment is symmetrical to a second central axis, and a distance between the outer lateral edge of the annular segment and the second central axis is defined as a second outer radius that is smaller than the first outer radius. The second central axis and the first central axis have an offset distance there-between that is larger than zero.

10 Claims, 5 Drawing Sheets

INFORMATION CARRIER AND TAG ANTENNA STRUCTURE THEREOF

FIELD OF THE DISCLOSURE

The present disclosure relates to an antenna structure, and more particularly to an information carrier and a tag antenna structure thereof.

BACKGROUND OF THE DISCLOSURE

A conventional information carrier (e.g., a game token) can transmit information stored therein to a reader. In other words, the reader can obtain different information from different conventional information carriers.

The conventional information carrier includes a tag antenna and an electronic chip electrically connected to the tag antenna, and the tag antenna and the electronic chip are cooperated with each other for storing information. However, when conventional information carriers are stacked together, the stacked conventional information carriers may cause a read problem, if the design of the tag antenna does not take into account the coupling effects among the stacked conventional information carriers. Particularly, if the conventional information carriers are aligned during stacking, it can be even more difficult for the reader to accurately read the information stored in each of the stacked conventional information carriers.

SUMMARY OF THE DISCLOSURE

In response to the above technical problems, the present disclosure provides an information carrier and a tag antenna structure thereof to effectively improve the performance of the stacked conventional information carriers.

In one aspect, the present disclosure provides an information carrier, which includes a carrying sheet, a sheet-like insulating protector, a tag antenna, and an electronic chip. The carrying sheet defines a first central axis. An outer lateral edge of the carrying sheet is symmetrical to the first central axis, and a distance between the outer lateral edge of the carrying sheet and the first central axis is defined as a first outer radius. The insulating protector has an outer lateral edge symmetrical to the first central axis. The carrying sheet is embedded in the insulating protector. The tag antenna is embedded in the insulating protector and disposed on the carrying sheet. The tag antenna includes an annular segment and two extending segments. The annular segment defines a second central axis. An outer lateral edge of the annular segment is symmetrical to the second central axis, and a distance between the outer lateral edge of the annular segment and the second central axis is defined as a second outer radius. The annular segment includes two end portions arranged adjacent to each other and spaced apart from each other. The two extending segments respectively extend from the two end portions toward the second central axis. The second outer radius is smaller than the first outer radius, and the second central axis and the first central axis have an offset distance there-between that is larger than zero. The electronic chip is embedded in the insulating protector, and the electronic chip is installed on the two extending segments and is located at the second central axis.

In one aspect, the present disclosure provides a tag antenna structure of an information carrier, which includes a carrying sheet and a tag antenna. The carrying sheet defines a first central axis. An outer lateral edge of the carrying sheet is symmetrical to the first central axis, and a distance between the outer lateral edge of the carrying sheet and the first central axis is defined as a first outer radius. The tag antenna is disposed on the carrying sheet, and includes an annular segment and two extending segments. The annular segment defines a second central axis. An outer lateral edge of the annular segment is symmetrical to the second central axis, and a distance between the outer lateral edge of the annular segment and the second central axis is defined as a second outer radius. The annular segment includes two end portions arranged adjacent to each other and spaced apart from each other. The two extending segments respectively extend from the two end portions toward the second central axis. The second outer radius is smaller than the first outer radius, and the second central axis and the first central axis have an offset distance there-between that is at least 50% of a difference between the first outer radius and the second outer radius.

In one aspect, the present disclosure provides an information carrier, which includes a sheet-like insulating protector, a tag antenna, and an electronic chip. The insulating protector defines a first central axis. An outer lateral edge of the insulating protector is symmetrical to the first central axis. The tag antenna is embedded in the insulating protector, and includes an annular segment and two extending segments. The annular segment defines a second central axis. An outer lateral edge of the annular segment is symmetrical to the second central axis. The annular segment includes two end portions arranged adjacent to each other and spaced apart from each other; the second central axis does not overlap with the first central axis. The second central axis and the first central axis have an offset distance there-between. The extending segments respectively extend from the two end portions toward the second central axis. The electronic chip is embedded in the insulating protector, and the electronic chip is installed on the two extending segments and is located at the second central axis.

Therefore, for the information carrier and the tag antenna structure of the present disclosure, the carrying sheet (and/or the insulating protector) is formed to be symmetrical to the first central axis, and the annular segment of the tag antenna is formed to be symmetrical to the second central axis that is spaced apart from the first central axis by the offset distance, so that the information carrier and the tag antenna structure can provide a better read performance. Moreover, when information carriers of the present disclosure are stacked together, the information carrier of the present disclosure may perform better than others.

Specifically, when information carriers of the present disclosure are stacked and aligned in one pile, a reader can still effectively read information (or data) stored in each of the stacked information carriers, which are respectively formed with the tag antennas each having an offset distance to significantly improve the read performance.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the detailed description and the accompanying drawings, in which.

DETAILED DESCRIPTION OF THE EXEMPLARY EMBODIMENTS

Figure 1:
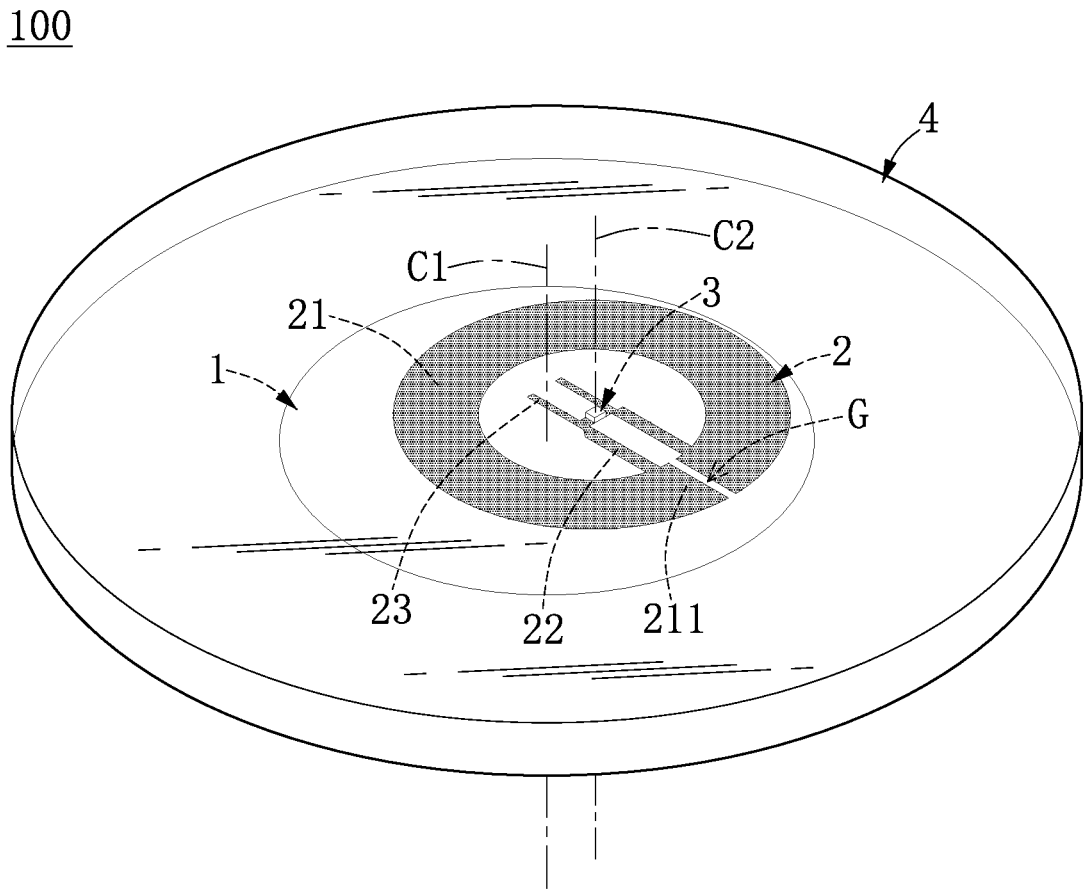
FIG. 1 is a perspective view of an information carrier according to a first embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

First Embodiment

Figure 2:
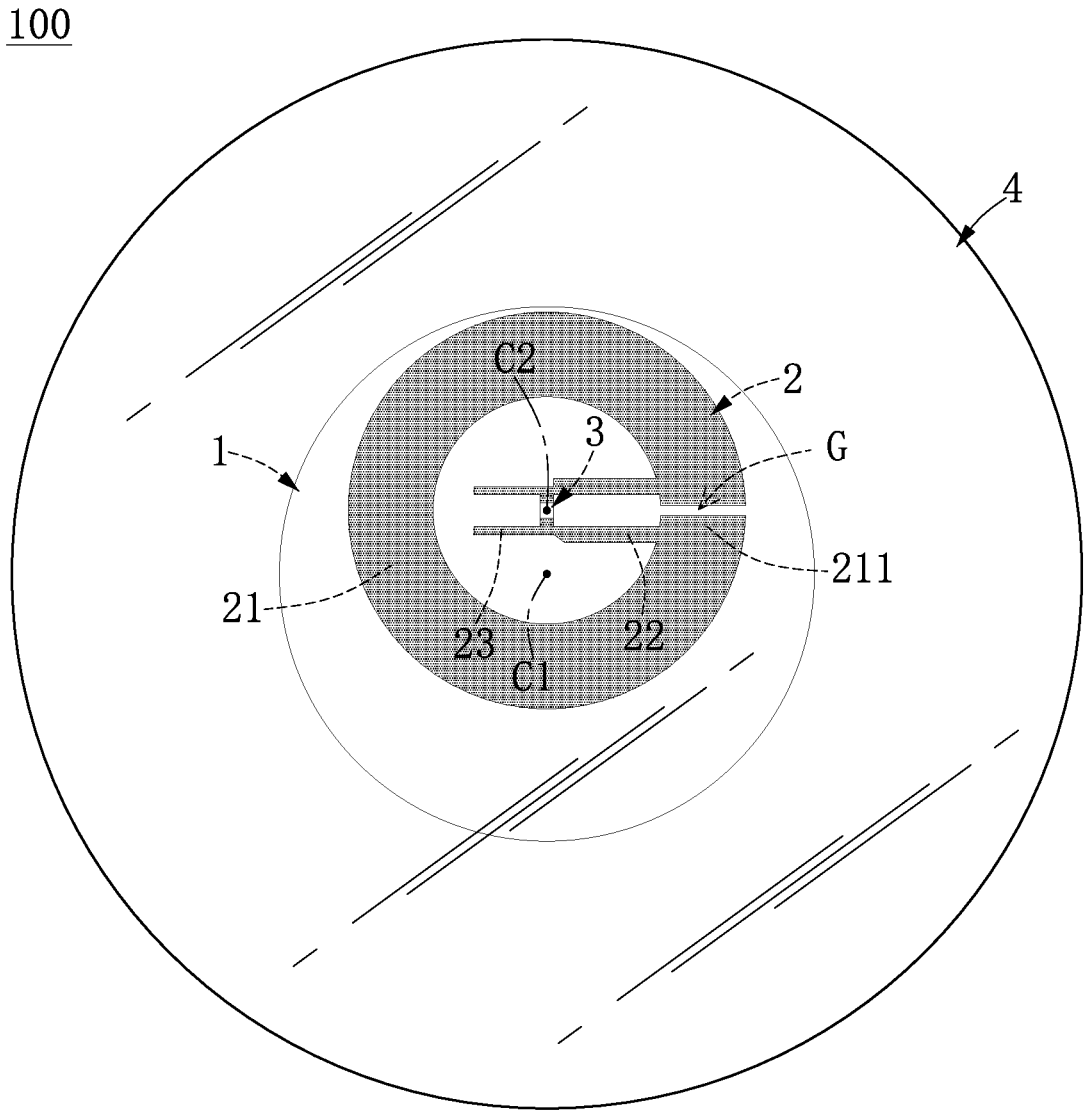
FIG. 2 is a planar view of FIG. 1.
Figure 3:
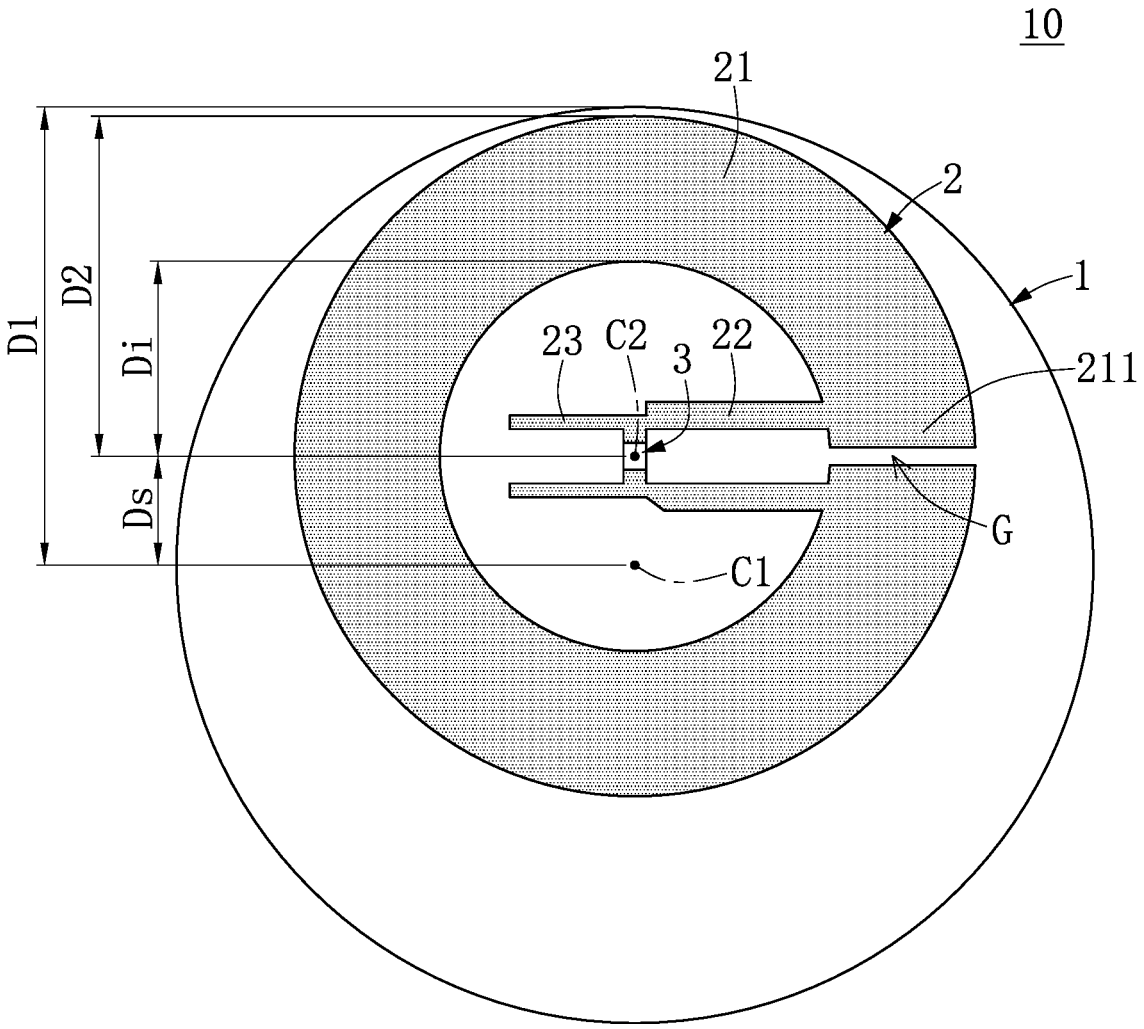
FIG. 3 is a planar view of a tag antenna structure of the information carrier according to the first embodiment of the present disclosure.

Referring to FIG. 1 to FIG. 3, a first embodiment of the present disclosure provides an information carrier 100 (e.g., a game token) for transmitting information (or data) stored or recorded therein to a reader (not shown). The information carrier 100 in the present embodiment is a sheet-like structure, and includes an insulating carrying sheet 1, a tag antenna 2 disposed on the carrying sheet 1, an electronic chip 3 electrically connected to the tag antenna 2, and a sheet-like insulating protector 4. The carrying sheet 1, the tag antenna 2, and the electronic chip 3 are entirely embedded in the insulating protector 4.

It should be noted that while the information carrier 100 in the present embodiment is disclosed with the above components, the present disclosure is not limited thereto. For example, in other embodiments of the present disclosure, the information carrier 100 can be provided without the carrying sheet 1, or the carrying sheet 1 of the information carrier 100 can be formed in any shape. Moreover, the carrying sheet 1 and the tag antenna 2 in the present embodiment can be co-defined as a tag antenna structure 10. In other words, the tag antenna structure 10 can be cooperated with other components different from the insulating protector 4 and the electronic chip 3. The following description discloses the structure and connection relationships of each component of the information carrier 100.

The carrying sheet 1 defines a first central axis C1, and an outer lateral edge of the carrying sheet 1 is symmetrical to the first central axis C1. The carrying sheet 1 in the present embodiment is made by an insulating material, and the outer lateral edge of the carrying sheet 1 is in a circular shape. In other words, the first central axis C1 is perpendicular to the carrying sheet 1, and passes through a center of circle of the carrying sheet 1. Moreover, a distance between the outer lateral edge of the carrying sheet 1 and the first central axis C1 is defined as a first outer radius D1.

The tag antenna 2 is disposed on the carrying sheet 1, and is disposed on a surface of the carrying sheet 1, but the present disclosure is not limited thereto. For example, in other embodiments of the present disclosure, the tag antenna 2 includes two portions respectively disposed on two opposite surfaces of the carrying sheet 1, and the two portions of the tag antenna 2 are electrically coupled to each other by forming a conductor that passes through the carrying sheet 1 (or that extends over the outer lateral edge of the carrying sheet 1) to connect the two portions.

The tag antenna 2 in the present embodiment includes an annular segment 21, two extending segments 22 connected to the annular segment 21, and two matching stub segments 23 respectively connected to the two extending segments 22. The tag antenna 2 in the present embodiment is integrally formed as a one-piece structure, but the present disclosure is not limited thereto. For example, in other embodiments of the present disclosure, the annular segment 21, the two extending segments 22, and the two matching stub segments 23 of the tag antenna 2 can be connected to each other by soldering.

Specifically, the annular segment 21 defines a second central axis C2, and an outer lateral edge of the annular segment 21 is symmetrical to the second central axis C2. The outer lateral edge of the annular segment 21 is in a circular shape. In other words, the second central axis C2 is perpendicular to the annular segment 21, and passes through a center of circle of the annular segment 21. Moreover, a distance between the outer lateral edge of the annular segment 21 and the second central axis C2 is defined as a second outer radius D2 that is smaller than the first outer radius D1. In addition, the second central axis C2 does not overlap with (and is parallel to) the first central axis C1, and the second central axis C2 and the first central axis C1 have an offset distance Ds there-between that is larger than zero. The offset distance Ds is preferably at least 50% of a difference between the first outer radius D1 and the second outer radius D2, and the offset distance Ds in the present embodiment is preferably at least 90% of the difference between the first outer radius D1 and the second outer radius D2, but the present disclosure is not limited thereto.

Moreover, the annular segment 21 includes two end portions 211 arranged adjacent to each other and spaced apart from each other, and the two end portions 211 of the annular segment 21 have a gap G there-between. In the present embodiment, the annular segment 21 is in a C-shape, the gap G is in an elongated shape, and an extending path defined by extending the gap G passes through the second central axis C2.

In addition, an inner lateral edge of the annular segment 21 and the second central axis C2 have an inner radius Di there-between, and the inner radius Di is preferably at least 50% of the second outer radius D2, but the present disclosure is not limited thereto.

The two extending segments 22 respectively extend from inner edges of the two end portions 211 of the annular segment 21 toward the second central axis C2. The two extending segments 22 are substantially parallel to each other, and each of the two extending segments 22 is parallel to a longitudinal direction of the gap G. In the present embodiment, a distance between the two extending segments 22 is preferably larger than a distance between the two end portions 211 of the annular segment 21, and each of the two extending segments 22 has a length substantially equal to the inner radius Di.

The two matching stub segments 23 respectively extend from the two extending segments 22, and each of the two matching stub segments 23 is spaced apart from the annular segment 21. Each of the two matching stub segments 23 preferably extends from an end of the corresponding extending segment 22 (e.g., a left end of each of the two extending segments 22 as shown in FIG. 3) adjacent to the second central axis C2, and a length of each of the two matching stub segments 23 can be adjusted according to design requirements.

It should be noted that the tag antenna 2 in the present embodiment is formed with the two matching stub segments 23, but in other embodiments of the present disclosure, the tag antenna 2 can be formed without any matching stub segment 23.

The electronic chip 3 is installed on the two extending segments 22 and is located at the second central axis C2. When the information carrier 100 communicates with a reader (not shown), the tag antenna 2 of the information carrier 100 receives signals from the reader and transmits the signals to the electronic chip 3, and then the electronic chip 3 emits feedback signals to the reader through the tag antenna 2.

The carrying sheet 1, the tag antenna 2 disposed on the carrying sheet 1, and the electronic chip 3 are embedded in the insulating protector 4. An outer lateral edge of the insulating protector 4 is symmetrical to the first central axis C1, and the outer lateral edge of the insulating protector 4 is in a circular shape. In other words, the first central axis C1 is perpendicular to the insulating protector 4, and passes through a center of circle of the insulating protector 4. Moreover, the first central axis C1 can be regarded as being defined by the insulating protector 4.

In addition, the information carrier 100 of the present embodiment excludes other antennas embedded in the insulating protector 4. In other words, the information carrier 100 of the present embodiment consists of the carrying sheet 1, the tag antenna 2, the electronic chip 3, and the insulating protector 4, but the present disclosure is not limited thereto.

As evidence that the information carrier 100 can produce the technical effects disclosed herein, a related simulation test of the information carrier 100 is performed in the present embodiment.

In the simulation test, a test group is the information carrier 100 of the present embodiment, and a control group is a conventional information carrier that has a tag antenna arranged at a center portion thereof. In the simulation test, twenty information carriers of the test/control groups are stacked in one pile, and the $M^{th}$ information carrier is rotated at 90 degrees in the clockwise direction with respect to the $(M-1)^{th}$ information carrier. Moreover, ten of the twenty stacked information carriers of the test/control groups that are positioned in the middle of the stacked twenty information carriers are tested in the simulation test. The results of the simulation test are disclosed in the following table

| | lower limit of impedance of real part (ohms) | change interval of real part (ohms) | upper limit of impedance of real part (ohms) |
|---|---|---|---|
| control group | 30.8 | 375.56 | 406.36 |
| test group | 2.23 | 2.81 | 5.04 |

| | lower limit of impedance of imaginary part (ohms) | change interval of imaginary part (ohms) | upper limit of impedance of imaginary part (ohms) |
|---|---|---|---|
| control group | 74 | 662 | 736 |
| test group | 159 | 44 | 203 |

| | lower limit of matching loss (dB) | upper limit of matching loss (dB) |
|---|---|---|
| control group | 7.9 | 12.2 |
| test group | 7.2 | 4.7 |

According to the above results of the simulation test, when a plurality of information carriers of the test/control groups are stacked in one pile, a part of the stacked information carriers 100 of the present embodiment positioned in the middle can have lower impedance change and lower matching loss, so that the information carrier 100 of the present embodiment can provide a better read performance to a reader.

Second Embodiment

Figure 4:
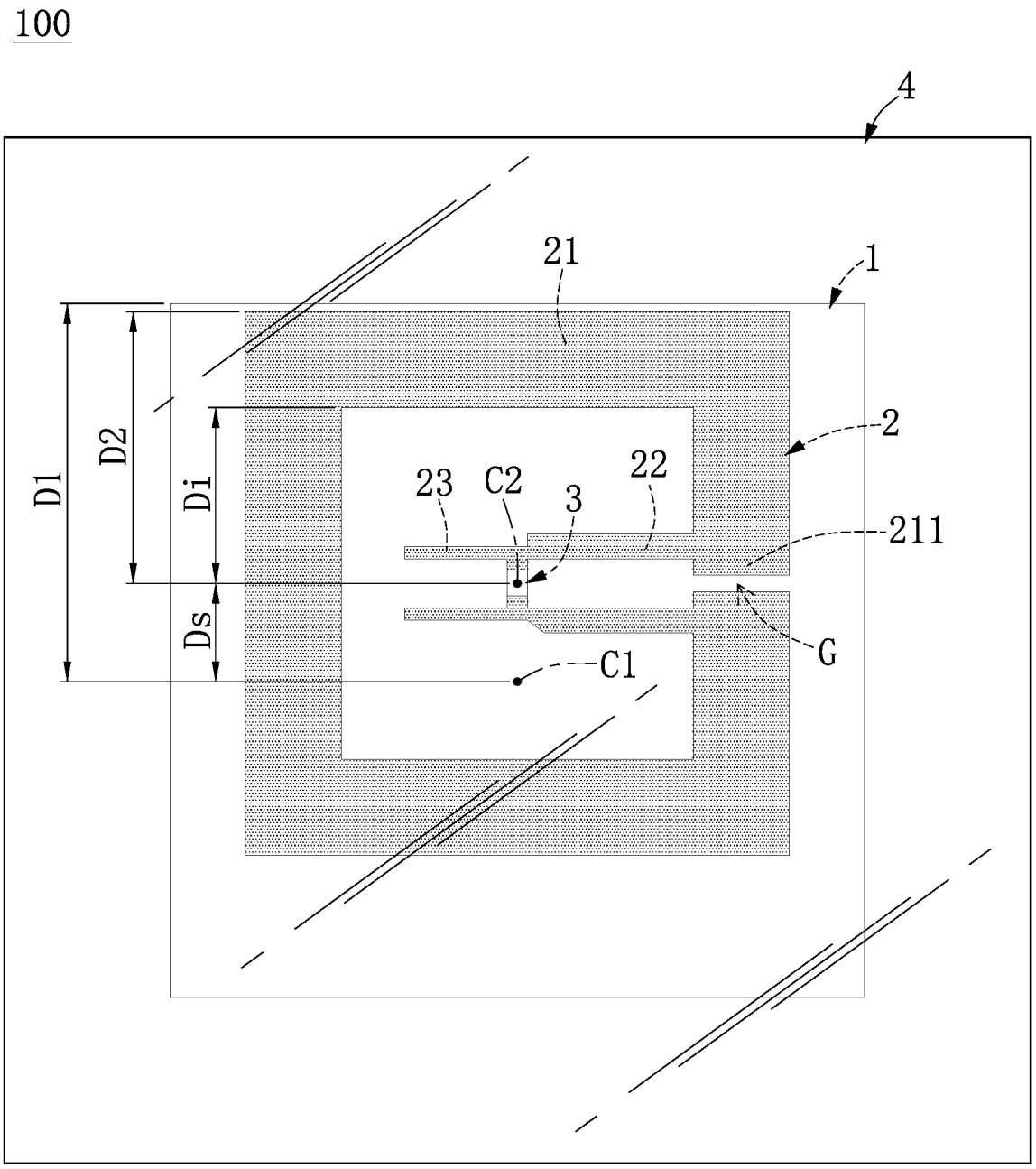
FIG. 4 is a planar view of the information carrier according to a second embodiment of the present disclosure.
Figure 5:
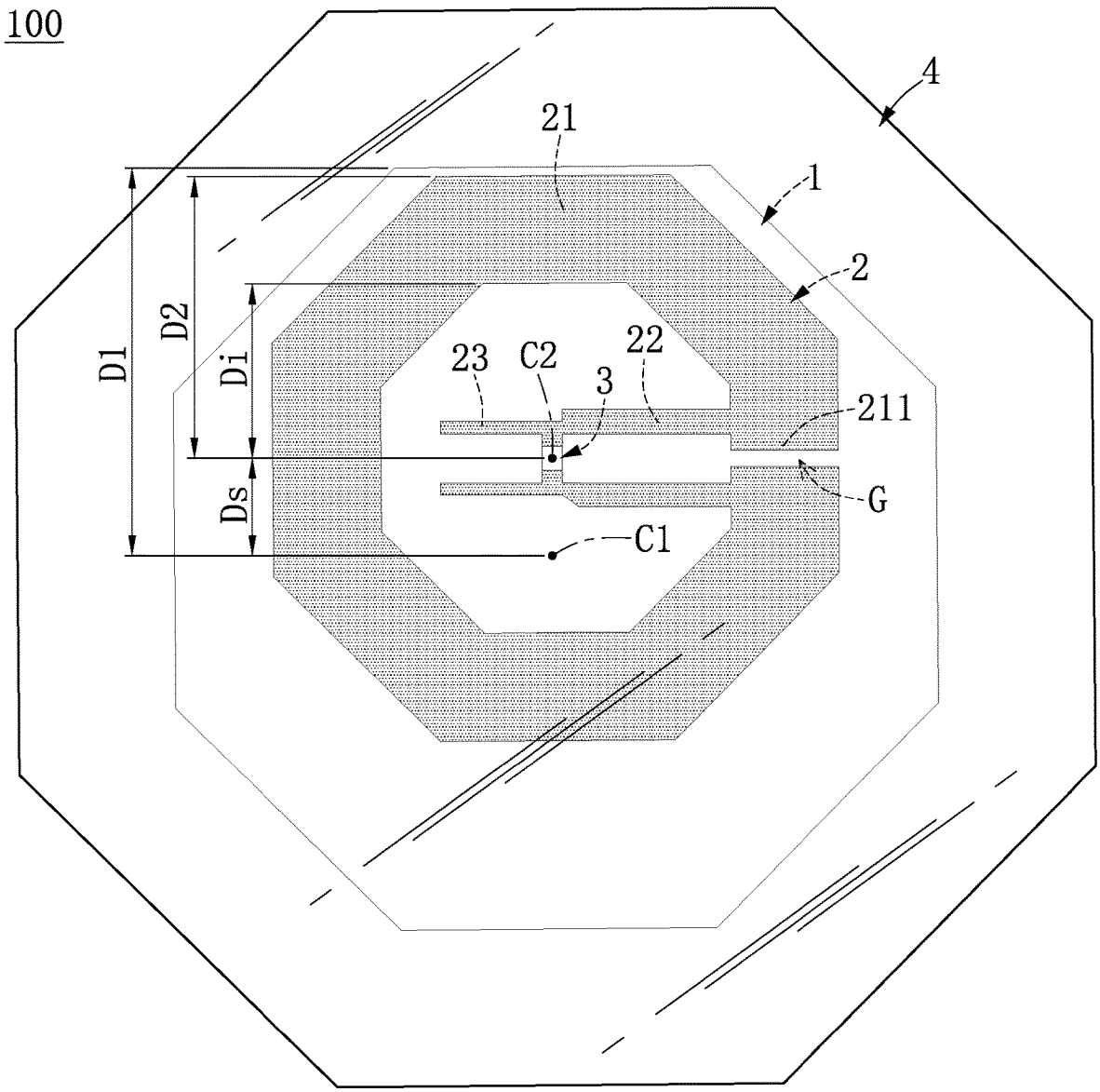
FIG. 5 is a planar view of the information carrier according to the second embodiment of the present disclosure in another configuration.

Referring to FIG. 4 and FIG. 5, a second embodiment of the present disclosure provides an information carrier 100. The present embodiment is similar to the first embodiment, and the difference between the two embodiments resides in the shape of the information carrier 100.

Specifically, each of the insulating protector 4, the carrying sheet 1, and the annular segment 21 of the tag antenna 2 is a substantially regular polygon having N numbers of edges, and N is a positive integer more than two. Moreover, corners of the insulating protector 4, corners of the carrying sheet 1, and corners of the annular segment 21 of the tag antenna 2 correspond in positions to each other. In other words, diagonals of the insulating protector 4, diagonals of the carrying sheet 1, and diagonals of the annular segment 21 of the tag antenna 2 are substantially parallel to each other, but the present disclosure is not limited thereto.

In the present embodiment, the first outer radius D1 is defined by a minimum distance between the outer lateral edge of the carrying sheet 1 and the first central axis C1, and the second outer radius D2 is defined by a minimum distance between the outer lateral edge of the annular segment 21 and the second central axis C2. Moreover, the inner radius Di is defined by a minimum distance between the inner lateral edge of the annular segment 21 and the second central axis C2.

In addition, the value of "N" in the present embodiment is four or eight, but the present disclosure is not limited thereto. In other words, if the value of "N" approaches infinity, the structure of the information carrier 100 of the present embodiment would be configured to approach (or be substantially equal to) the structure of the information carrier 100 of the first embodiment.

According to the above first and second embodiments, the carrying sheet 1, the annular segment 21 of the tag antenna 2, and the insulating protector 4 of the information carrier 100 can be formed with different shapes. For example, in other embodiments of the present disclosure, each of the carrying sheet 1 and the insulating protector 4 can be formed in a circular shape, and the annular segment 21 of the tag antenna 2 can be formed in a regular polygon shape having N numbers of edges.

In conclusions, for the information carrier 100 and the tag antenna structure 10 of the present disclosure, the carrying sheet 1 (and/or the insulating protector 4) is formed to be symmetrical to the first central axis C1, and the annular segment 21 of the tag antenna 2 is formed to be symmetrical to the second central axis C2 that is spaced apart from the first central axis C1 by the offset distance Ds, so that the information carrier 100 and the tag antenna structure 10 can be provided with a better read performance. Moreover, when information carriers 100 are stacked in one pile, the information carrier 100 of the present disclosure can still perform well.

Specifically, when information carriers 100 of the present disclosure are stacked and aligned in one pile, a reader can still effectively read information (or data) stored in each of the stacked information carriers 100, which are formed with the tag antennas 2 each having an offset distance Ds to significantly improve the read performance.

Moreover, the information carrier 100 may provide a better readable performance by adjusting the offset distance Ds to be at least 50% of the difference between the first outer radius D1 and the second outer radius D2.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical applications so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. An information carrier, comprising:

a carrying sheet defining a first central axis, wherein an outer lateral edge of the carrying sheet is symmetrical to the first central axis, and a distance between the outer lateral edge of the carrying sheet and the first central axis is defined as a first outer radius;

a sheet-like insulating protector having an outer lateral edge symmetrical to the first central axis, wherein the carrying sheet is embedded in the insulating protector;

a tag antenna embedded in the insulating protector and disposed on the carrying sheet, wherein the tag antenna includes:

an annular segment defining a second central axis, wherein an outer lateral edge of the annular segment is symmetrical to the second central axis, and a distance between the outer lateral edge of the annular segment and the second central axis is defined as a second outer radius; the annular segment includes two end portions arranged adjacent to each other and spaced apart from each other; and two extending segments respectively extending from the two end portions toward the second central axis, wherein the second outer radius is smaller than the first outer radius, and the second central axis and the first central axis have an offset distance there-between that is larger than zero; and an electronic chip embedded in the insulating protector, wherein the electronic chip is installed on the two extending segments and is located at the second central axis, wherein an inner lateral edge of the annular segment surrounds the first central axis, and the inner lateral edge of the annular segment and the second central axis have an inner radius there-between that is greater than the offset distance.

2. The information carrier according to claim 1, wherein each of the outer lateral edge of the insulating protector and the outer lateral edge of the carrying sheet is in a circular shape, and the annular segment is in a circular shape.

3. The information carrier according to claim 2, wherein the offset distance is at least 90% of a difference between the first outer radius and the second outer radius.

4. The information carrier according to claim 1, wherein the tag antenna further includes two matching stub segments respectively extending from the two extending segments, and each of the two matching stub segments is spaced apart from the annular segment.

5. The information carrier according to claim 1, wherein the two end portions of the annular segment have a gap there-between, and an extending path defined by extending the gap passes through the second central axis.

6. The information carrier according to claim 5, wherein the two extending segments are substantially parallel to each other, each of the two extending segments is parallel to a longitudinal direction of the gap, and a distance between the two extending segments is larger than a distance between the two end portions of the annular segment.

7. The information carrier according to claim 1, wherein the offset distance is at least 50% of a difference between the first outer radius and the second outer radius.

8. The information carrier according to claim 1, wherein each of the insulating protector, the carrying sheet, and the annular segment is a regular polygon having N numbers of edges, and N is a positive integer more than two.

9. A tag antenna structure of an information carrier, comprising:

a carrying sheet defining a first central axis, wherein an outer lateral edge of the carrying sheet is symmetrical to the first central axis, and a distance between the outer lateral edge of the carrying sheet and the first central axis is defined as a first outer radius; and a tag antenna disposed on the carrying sheet and including:

an annular segment defining a second central axis, wherein an outer lateral edge of the annular segment is symmetrical to the second central axis, and a distance between the outer lateral edge of the annular segment and the second central axis is defined as a second outer radius; the annular segment includes two end portions arranged adjacent to each other and spaced apart from each other; and two extending segments respectively extending from the two end portions toward the second central axis, wherein the second outer radius is smaller than the first outer radius, and the second central axis and the first central axis have an offset distance there-between that is at least 50% of a difference between the first outer radius and the second outer radius, wherein an inner lateral edge of the annular segment surrounds the first central axis, and the inner lateral edge of the annular segment and the second central axis have an inner radius there-between that is greater than the offset distance.

10. An information carrier, comprising:

a sheet-like insulating protector defining a first central axis, wherein an outer lateral edge of the insulating protector is symmetrical to the first central axis;

a tag antenna embedded in the insulating protector and including:

an annular segment defining a second central axis, wherein an outer lateral edge of the annular segment is symmetrical to the second central axis; the annular segment includes two end portions arranged adjacent to each other and spaced apart from each other; the second central axis does not overlap with the first central axis, and the second central axis and the first central axis have an offset distance there-between; and two extending segments respectively extending from the two end portions toward the second central axis; and an electronic chip embedded in the insulating protector, wherein the electronic chip is installed on the two extending segments and is located at the second central axis, wherein an inner lateral edge of the annular segment surrounds the first central axis, and the inner lateral edge of the annular segment and the second central axis have an inner radius there-between that is greater than the offset distance.

* * * * *